United States Patent [19]

Siegel

[11] Patent Number: 4,694,996

[45] Date of Patent: Sep. 22, 1987

[54] MULTI CAVITY MEDICATION CARD CRUSHER

[75] Inventor: Harold B. Siegel, Clearwater, Fla.

[73] Assignee: Siegel Family Revocable Trust, Clearwater, Fla.

[21] Appl. No.: 920,678

[22] Filed: Oct. 20, 1986

[51] Int. Cl.[4] ..... B02C 1/00

[52] U.S. Cl. ..... 241/100; 100/268; 100/295; 241/101.1; 241/169; 241/270; 241/DIG. 27

[58] Field of Search ..... 100/266, 268, 218, 295, 100/260, 261, 262, 263, 39; 241/100, 101.1, 101.2, 270, 168, 169, DIG. 27

[56] References Cited

U.S. PATENT DOCUMENTS

| | | | |
|---|---|---|---|
| 2,506,970 | 5/1950 | Paul | 100/295 X |
| 2,572,378 | 10/1951 | Paul | 241/270 X |
| 2,631,786 | 3/1953 | Morgan et al. | 241/DIG. 27 X |
| 3,400,655 | 9/1968 | Leskinen | 100/295 |
| 3,648,600 | 3/1972 | Jaccard | 100/295 X |

*Primary Examiner*—Mark Rosenbaum
*Attorney, Agent, or Firm*—Pettis & McDonald

[57] ABSTRACT

An apparatus for crushing multi cavity medication cards wherein each cavity serves as a receptacle containing individual doses of medication such as, for example, pills or tablets. The apparatus includes a frame with a reciprocally movable platen and changeable medication card support plates mounted below the movable platen. Dependent upon the configuration of the card to be crushed, a crusher plate is attached to the platen having protrusions formed thereon to engage each of the cavities of the card. The card support plate may be of a substantially solid construction for crushing pills contained within each cavity of the card, or may be apertured so as to permit expulsion of the medication from the card as the card is crushed.

9 Claims, 10 Drawing Figures

MULTI CAVITY MEDICATION CARD CRUSHER

BACKGROUND OF THE INVENTION

1. Field of the Invention

The present invention relates to an apparatus for crushing multi cavity medication cards, and also includes interchangeable means whereby medication contained within the card may also be crushed, or may be expelled from the card without damage for subsequent use or destruction. The invention is characterized by its construction including a reciprocating platen to which one of a variety of crusher plates may be attached. The particular crusher plate is chosen to correspond to the configuration of the multi cavity medication card to be crushed. The card crusher is further characterized by its construction to comprise means for utilization of one of a plurality of card support plates upon which the medication card to be crushed is placed. One such plate is solid so that when the device is actuated to crush the card, it will also destroy any medication contained within each of the cavities. Another variety of card support plate includes apertures formed therethrough. This second construction comprising an apertured support plate is provided in a variety of aperture configurations corresponding to the cavity configurations on the card to be crushed. When a medication card is placed on the apertured support plate and the device of this invention is operated, crushing of the card results in expulsion of any medication contained within each cavity through the bottom of the card and through the apertures of the plate. A medication receptacle is provided to catch the medication as it is expelled from the crushed card.

2. Description of the Prior Art

Within the medical service profession, if often occurs that a particular patient is to receive a unit dose of medication at regularly occurring intervals such as, for example, once a day. Both for purposes of insuring that medication is properly administered and taken, as well as for maintaining effective cost control, it is quite common to administer such regularly repeating doses of medication by packaging the medication in multi cavity blister cards containing individually sealed doses for a week, a month, or even longer. Such cards are commonly referred to within the profession as multi cavity cards or "bingo cards."

While numerous devices are known in the prior art for preparing, filling and sealing multi cavity medication cards, it often becomes necessary to destroy a card before all its medication has been administered. Destruction of the card and any medication contained therein is often required because the medications are controlled substances which may not be merely placed in the trash. In other circumstances, it is sometimes desirable to remove unused medication without damaging it for subsequent use in another card, or for subsequent control or destruction. Heretofore, the only significant means for removing medication in filled and sealed multi cavity cards was for an individual manually to punch each pill or tablet from its cavity. Not only is such a procedure extremely inefficient from the point of view of time utilization, but also such a procedure would clearly be subject to abuse.

While it certainly could not be denied that at a manufacturing level large, automated means for rupturing filled and sealed multi cavity medication cards are most surely available, the vast majority of such cards are used in hospitals or nursing homes. It is therefore clear that there is a great need in the art for a simple, yet efficient and safe means for crushing filled multi cavity medication cards so as to destroy the medication contained therein, or, alternatively, so as to remove the medication therefrom. Considering that such a device would quite frequently be utilized in medium and small nursing homes, a reliable yet relatively inexpensive apparatus is desired. Furthermore, because the size and configuration of the cavities on such medication cards vary, a truly efficient card crusher should include means for adapting its use to the wide variety of medication card configurations.

SUMMARY OF THE INVENTION

The present invention relates to an apparatus for crushing multi cavity medication cards. As will be explained in greater detail, the construction of the apparatus of this invention permits its use with a wide variety of medication card configurations, and also permits its use for alternatively crushing any medication contained within the cavity of a filled card or for expelling the medication therefrom in an undamaged condition.

The crushing apparatus of this invention comprises a frame means including a pair of oppositely disposed base plates, a top plate, and four legs disposed in interconnecting relation between the top plate and the base plate. For purposes of clarity, it should be noted that the top plate includes a top surface and a bottom surface. Mounted on the top plate is a crusher means which actually provides the force for crushing the multi cavity medication card. In its preferred construction, the crushing apparatus, and therefore the crusher means, is manually operated by a lever. It is to be understood that the apparatus of this invention could be modified for automatic operation by, for example, a pneumatic valve. The lever extends upwardly above the top plate and is mechanically linked to a piston which extends through a central aperture of the top plate. The distal end of the piston is fixed to a crusher platen which is disposed adjacent the bottom surface of the top plate. Operation of the lever thereby causes the crusher platen to move downwardly. Biasing means are also provided whereby the platen, and therefore the piston and lever, are normally urged to an up position.

Finally, the crusher means comprises a crusher plate which is removably attachable to the crusher platen. The crusher plate defines a planar surface adjacent the crusher platen and an opposite, exposed surface including a plurality of protrusions formed thereon. Each one of the protrusions is spaced and configured to register with a medication cavity of a multi cavity medication card. A variety of crusher plate configurations are provided so that the apparatus of this invention can be used effectively with a corresponding variety of medication cards.

The crushing apparatus further comprises medication card support means mounted on the frame legs beneath the crusher means and above the base plates of the apparatus frame. The card support means comprise a pair of oppositely disposed guide rails, with one of said pair of rails being attached on each side of the apparatus in substantially parallel relation to a corresponding one of the base plates. Each of the guide rails comprises an upper guide track and a lower guide track whereby a multi cavity medication card may be inserted into the card support means and crushed by the action of the crusher means.

Inasmuch as the apparatus of this invention may be utilized to crush the card and any medication contained therein, or to crush the card so as to expel any medication contained therein without damage, the medication card support means further comprises a first card support plate dimensioned and configured to be received in the lower guide tracks and a second card support plate dimensioned and configured to be received in the upper guide tracks. The first card support plate defines a planar, solid surface so that operation of the crusher means of this apparatus against a medication card placed thereon will not only crush the card, but also any medication contained therein. The second card support plate also defines a planar surface but includes a plurality of cavity apertures formed therethrough in corresponding relation to the medication cavities of the card being placed thereon. Thus, when the second card support plate is used, crushing of the card will expel any medication contained therein from the card and through the cavity apertures. For purposes of receiving and collecting any such expelled medication, the card support means may further comprise a medication receptacle dimensioned and configured to be received in the lower guide tracks.

Just as the crusher plate of the apparatus is chosen to correspond with the configuration of the medication card being crushed, so would the particular second card support plate be chosen.

It should also be noted that the top plate of the frame means further comprises, in its preferred construction, a plurality of guide pins extending normally from the top plate bottom surface. Both the crusher platen and the crusher plate comprise a plurality of corresponding guide apertures formed therethrough in receiving relation to corresponding ones of the guide pins in order to insure proper registry of each of the crusher plate protrusions with a corresponding cavity of the multi cavity medication card to be crushed.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
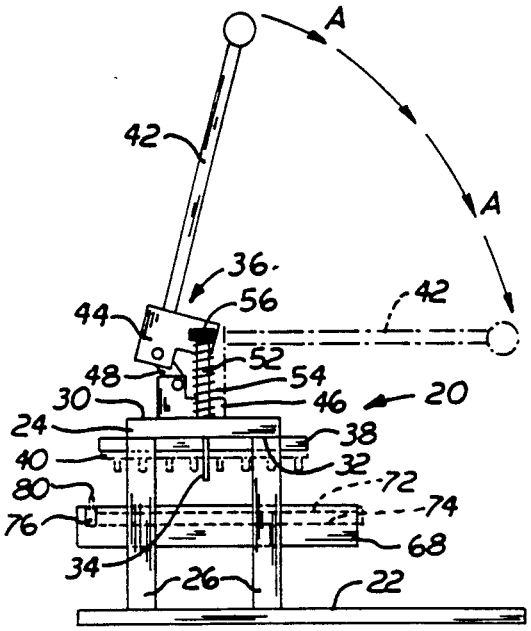
FIG. 1 is a side elevation of the crushing apparatus illustrating operation of the crusher means in phantom.
Figure 2:
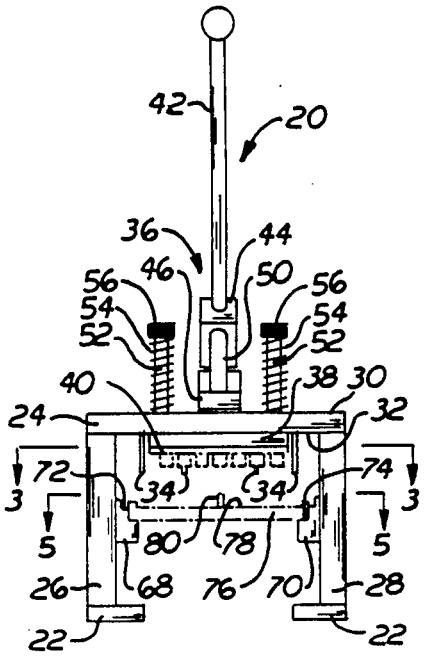
FIG. 2 is a front elevation of the apparatus shown in FIG. 1.

The multi cavity medication card crushing apparatus is generally indicated as 20 in the views of FIGS. 1 and 2. While this preferred embodiment for apparatus 20 is manually operated, it is to be understood that the crusher of this invention is not limited to manual operation, for it could be easily adapted for automatic operation. Referring to the views of FIGS. 1 and 2, it can be seen that apparatus 20 comprises a frame means including a pair of oppositely disposed base plates 22, a top plate 24, and a plurality of legs 26 and 28 disposed in interconnecting relation between top plate 24 and base plates 22. The means for fixedly interconnecting legs 26 and 28 between top plate 24 and base plates 22 may be any suitable fastening means such as, for example, screws or bolts. It is also to be noted that top plate 24 defines a top surface 30 and a bottom surface 32. A plurality of guide pins 34 extend downwardly from bottom surface 32 in substantially perpendicular relationship thereto.

Crusher means comprising a crusher platen actuator means generally indicated as 36 mounted on top surface 30, a crusher platen 38 disposed adjacent bottom surface 32, and a crusher plate means 40 removably attached to crusher platen 38 are provided. Though not shown in the drawing figures, crusher plate means 40 may be removably attachable to crusher platen 38 by any suitable fastener such as, for example, screws or bolts. As perhaps best seen in the view of FIG. 1, in this preferred, manual embodiment of apparatus 20, the crusher platen actuator means 36 is operated by depressing lever 42 downwardly as indicated by arrows A. One end of lever 42 is fixedly attached to a first actuator bracket 44, and first bracket 44 is operatively connected to a second actuator bracket 46 by link 48. Actuator means 36 further comprises a piston 50, the top end of which is pivotally attached to first bracket 44 and the opposite end of which passes through second bracket 46, through a central aperture (not shown) of top plate 24, and is fixedly attached to crusher platen 38.

Figure 6:
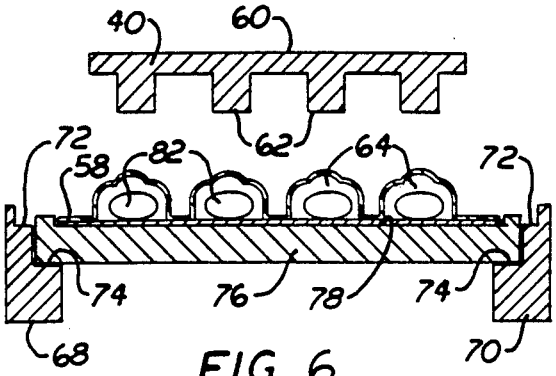
FIG. 6 is a fragmentary sectional view of the crusher plate and the medication card support means having a first card support plate mounted therein and a filled multi cavity medication card placed thereon.
Figure 7:
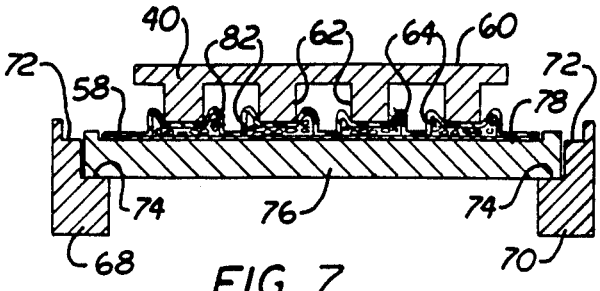
FIG. 7 is a fragmentary sectional view similar to that of FIG. 6 showing the crushing action of the crusher plate against a medication card disposed on a first card support plate.
Figure 9:
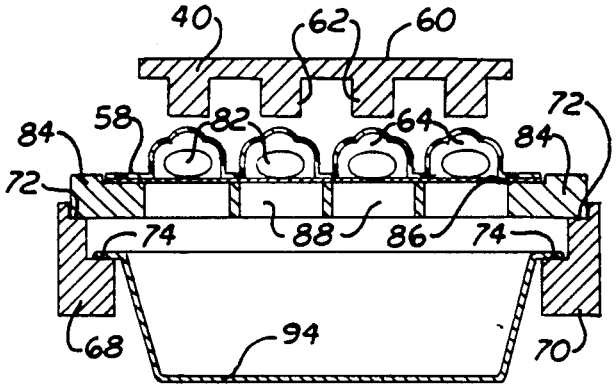
FIG. 9 is a fragmentary sectional view similar to that of FIG. 6 illustrating a medication card support means including a second card support plate mounted thereon.
Figure 10:
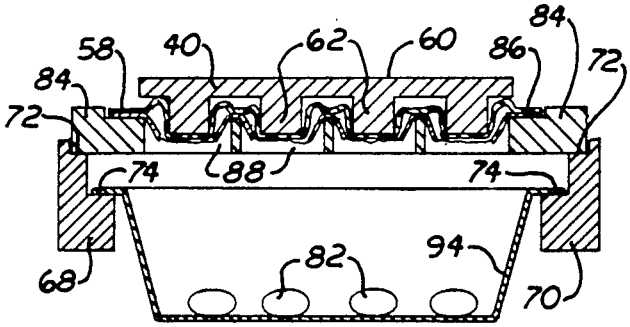
FIG. 10 is a fragmentary sectional view similar to that of FIG. 9 illustrating the crushing and expelling action of the crusher plate when used in combination with the second card support plate so that expelled medication is received within a medication receptacle.

Crusher platen 38 and the crusher plate means 40 attached thereto are normally maintained in the raised position illustrated in the views of FIGS. 1 and 2 as by biasing means comprising biasing pins 52 and springs 54. The head 56 of each of the pins 52 is enlarged to provide a stop for the top end of each spring 54. A corresponding bottom stop for each of the springs 54 is provided by top surface 30 of top plate 24. The pins 52 extend through biasing apertures (not shown) formed through top plate 54 and are fixedly attached to crusher platen 38. The fragmentary sectional views of FIGS. 6 and 9 illustrate a crusher plate means 40 in the normally-biased up position of FIGS. 1 and 2. The fragmentary sectional views of FIGS. 7 and 10 illustrate the positions of crusher plate means 40 when lever 42 is depressed as shown in phantom in the view of FIG. 1.

Figure 3:
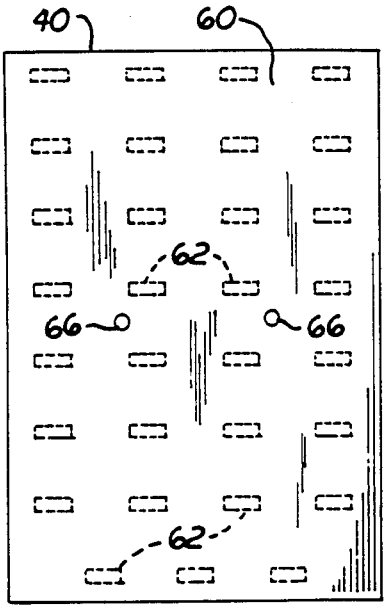
FIG. 3 is a top plan view of one embodiment of the crusher plate taken along line 3—3 of FIG. 2.
Figure 4:
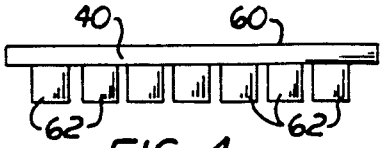
FIG. 4 is an end elevation of the crusher plate shown in FIG. 3.
Figure 5:
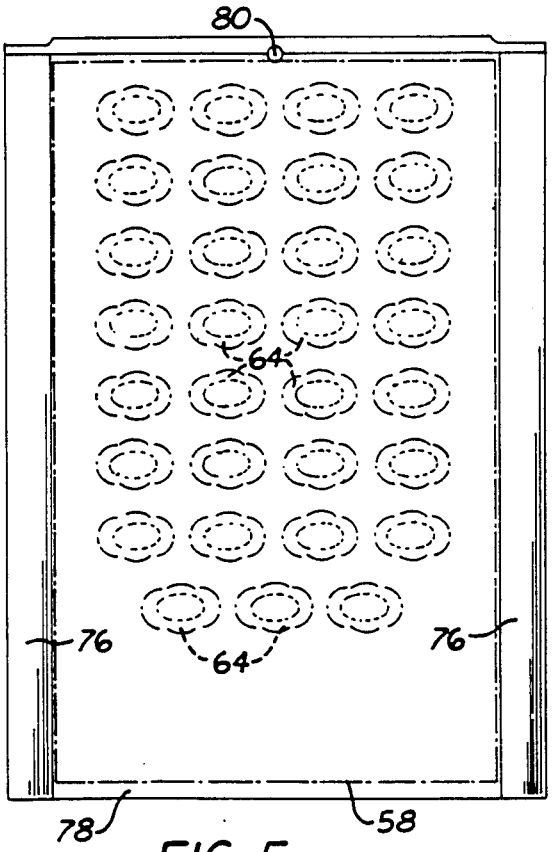
FIG. 5 is a top plan view of the first card support plate and illustrating in phantom a multi cavity medication card placed thereon taken along line 5—5 of FIG. 2.

Attention is now invited to the views of FIGS. 3 and 4 for a more detailed description of the construction of crusher plate means 40. In this regard, it is to be noted that the embodiment for crusher plate means 40 shown in the views of FIGS. 3 and 4 is exemplary and is specifically constructed for use in combination with the multi cavity medication card 58 represented in phantom in the view of FIG. 5. Crusher plate means 40 comprises a planar surface 60 that is operatively mounted adjacent the crusher platen 38. The opposite, exposed surface of plate means 40 comprises a plurality of protrusions 62 extending therefrom. By comparing the views of FIGS. 3 and 5, one may see that each of the protrusions 62 will be in registry with a corresponding one of the medication cavities 64 of card 58. Crusher plate means 40 further comprises a plurality of guide apertures 66 formed therethrough in receiving relation to corresponding ones of the guide pins 34. This receiving relationship between guide aperture 66 and corresponding ones of the guide pins 34 ensures proper registry of the protrusions 62 with corresponding ones of the medication cavities 64.

The multi cavity medication card crusher 20 further comprises medication card support means including a pair of oppositely disposed guide rails 68 and 70. Rail 68 is fixedly attached to legs 26 as shown in the view of FIG. 1, and rail 70 is similarly attached to legs 28. As perhaps best seen in the views of FIGS. 6, 7, 9 and 10, each of the rails 68 and 70 is correspondingly configured to define upper guide track 72 and a lower guide track 74 thereon.

The medication card support means further comprises a first card support plate 76 dimensioned and configured to be received in lower guide tracks 74, as shown in the views of FIGS. 1, 2, 5, 6 and 7. First plate 76 defines a substantially planar, solid surface 78 onto which a multi cavity medication card 58 may be placed. A card stop means comprising first plate pin 80 extends upwardly from surface 78 to insure proper positioning of card 58 onto first card support plate 76. Referring to the views of FIGS. 6 and 7, it can be seen that utilization of first card support plate 76 is appropriate when one wishes to crush medication card 58 and any medication 82 still present within any of the medication cavities 64.

Figure 8:
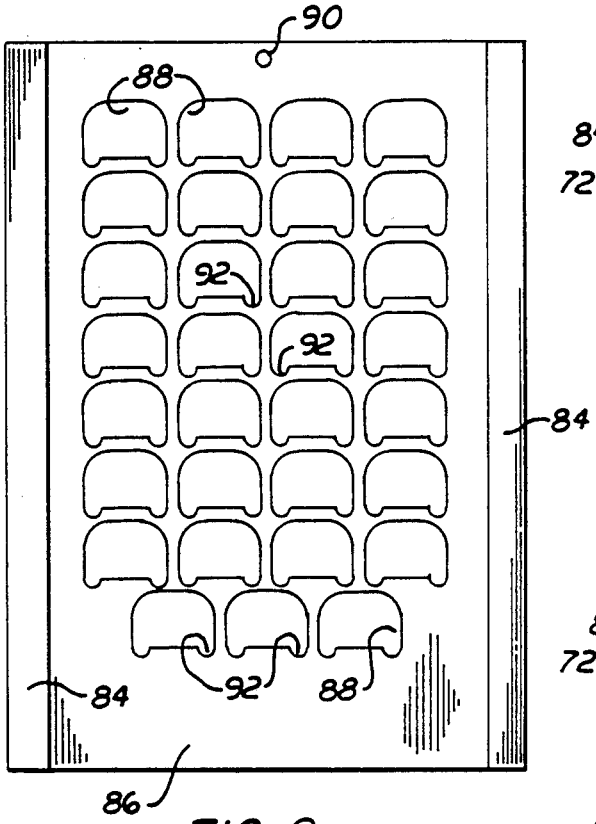
FIG. 8 is a top plan view of a preferred embodiment for a second card support plate.

The medication card support means may further comprise a second card support plate 84 dimensioned and configured to be received in upper guide tracks 72. An exemplar construction for second card support plate 84 is shown in the views of FIGS. 8, 9 and 10. Second support plate 84 defines a substantially planar surface 86 including a plurality of cavity apertures 88 formed therethrough. As most clearly seen in the views of FIGS. 9 and 10, the relative size and placement of cavity apertures 88 through second plate 84 is chosen so that each cavity aperture 88 will be in vertical registry with at least a corresponding one of the medication cavities 64. As did first card support plate 76, second card support plate 84 also includes card stop means defined by second plate pin 90 for the purpose of insuring correct placement of medication card 58 thereon so that each of the cavity apertures 88 will be in proper registry with at least one of the medication cavities 64. It should also be noted that each of the cavity apertures 88 is formed to define a pair of rounded cutouts 92. Some varieties of medication cards 58 include what might best be described as a "trap door" closure beneath each of the medication cavities 64. The construction of such closures includes a hinged portion which corresponds to cutouts 92. Accordingly, the cutouts 92 permit use of the second card support plate 84 with such medication cards 58.

Referring to the views of FIGS. 9 and 10 it can be seen that when utilizing second card support plate 84 not only for crushing medication card 58, but also for removing any medication 82 still remaining in cavities 64 without damanging the medication 82, the medication card support means may further comprise a medication receptacle 94 dimensioned and configured to be received in lower guide tracks 74. For example, and without specific limitation, medication receptacle 94 may comprise a pan-type device.

Having thus set forth a preferred construction for the multi cavity medication card crushing apparatus 20, its use and operation is clearly illustrated in the drawing figures. Dependent upon the configuration of the medication card 58 to be crushed, an appropriate crusher plate means 40 is operatively attached to crusher platen 38. Depending upon whether one wishes to crush any medication 82 still present within cavity 64 of the medication card 58 either first card support plate 76 or second card support plate 84 is selected and inserted into the medication card support means.

In conclusion, it is to be noted that the specific configurations and placement of protrusions 62 on the crusher plate means 40 are determined with respect to the medication card 58 to be crushed. In similar fashion, the specific configuration and placement of cavity apertures 88 through second card support plate 84 are also determined with respect to the configuration of medication card 58.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. An apparatus for crushing multi cavity medication cards, said apparatus comprising: frame means comprising a pair of oppositely disposed base plates, a top plate, and a plurality of legs disposed in interconnecting relation between said top plate and said base plates, said top plate further comprising a top surface and a bottom surface; a crusher means mounted on said top plate, said crusher means comprising crusher platen actuator means mounted on said top surface of said top plate, a crusher platen disposed adjacent said bottom surface of said top plate and operatively attached to said actuator means for reciprocal movement in directions normal to the plane of said bottom surface, and crusher plate means removably attachable to said crusher platen, said crusher plate means comprising a planar surface adjacent said crusher platen and an opposite, exposed surface comprising a plurality of protrusions found thereon, each one of said protrusions being in registry with a medication cavity of a multi cavity medication card; and medication card support means comprising a pair of oppositely disposed guide rails, one of said pair of guide rails being attached in spaced above, substantially parallel relation to a corresponding one of said base plates, each of said guide rails comprising an upper guide track and a lower guide track formed thereon, whereby a multi cavity medication card may be inserted into said card support means and may be crushed by the action of said crusher means to render the card useless.

2. An apparatus as in claim 1 wherein said frame means further comprises a plurality of guide pins extending normally from said top plate bottom surface and wherein said top plate is apertured to permit mounting said crusher means thereon.

3. An apparatus as in claim 2 wherein said crusher platen actuator means comprises a piston extending through a central aperture of said top plate whereby said crusher platen is operatively attached to said actuator means, and a plurality of biasing means operatively attached through said top plate to said crusher platen whereby said crusher means is normally urged to a retracted, non-engaging relation to a medication card inserted into said card support means.

4. An apparatus as in claim 2 wherein said crusher platen and said crusher plate comprise a plurality of corresponding guide apertures formed therethrough in receiving relation to corresponding ones of said guide pins, whereby proper registry of each one of said plurality of protrusions with a corresponding cavity of the multi cavity medication card is insured.

5. An apparatus as in claim 1 wherein said medication card support means further comprises a first card support plate dimensioned and configured to be received in said lower guide tracks.

6. An apparatus as in claim 5 wherein said first plate defines a planar, solid surface, whereby a multi cavity medication card placed thereon may be crushed and any medication disposed within the cavities will also be crushed.

7. An apparatus as in claim 1 wherein said medication card support means further comprises a second card support plate dimensioned and configured to be received in said upper guide tracks.

8. An apparatus as in claim 7 wherein said second plate defines a planar surface including a plurality of cavity apertures formed therethrough, whereby a multi cavity medication card placed thereon may be crushed and any medication disposed within the cavities will pass through said cavity apertures.

9. An apparatus as in claim 8 wherein said medication card support means further comprises a medication receptacle dimensioned and configured to be received in said lower guide tracks, whereby any medication passing through said cavity apertures will be collected in said receptacle.

* * * * *